US006467243B1

(12) United States Patent
Su et al.

(10) Patent No.: US 6,467,243 B1
(45) Date of Patent: Oct. 22, 2002

(54) STRAPPING MACHINE WITH A STRAP TIGHTENING ADJUSTMENT UNIT

(76) Inventors: Chi-Jan Su, No. 18, Alley 3, Lane 62, Sec. 1, Chih-Cheng Rd., Shih-Lin Dist., Taipei City (TW); Chin-Chang Liu, No. 30, Alley 13, Lane 17, Feng-Le Rd., Pai-Tun Dist., Taichung City (TW)

( * ) Notice: Subject to any disclaimer, the term of this patent is extended or adjusted under 35 U.S.C. 154(b) by 0 days.

(21) Appl. No.: 09/916,629

(22) Filed: Jul. 27, 2001

(51) Int. Cl.[7] ..... B65B 13/04; B65B 57/10; B65B 13/24

(52) U.S. Cl. ..... 53/589; 100/4; 100/29

(58) Field of Search ..... 100/4, 26, 29; 53/494, 67, 74, 589

(56) References Cited

U.S. PATENT DOCUMENTS

RE27,744 E * 8/1973 Billett et al. ..... 100/26
4,378,262 A * 3/1983 Annis, Jr. ..... 100/29
4,516,488 A * 5/1985 Bartzick et al. ..... 100/26
4,569,186 A * 2/1986 Mori et al. ..... 100/29
5,267,508 A * 12/1993 Yoshino ..... 100/26
5,377,477 A * 1/1995 Haberstroh et al. ..... 100/29
5,809,873 A * 9/1998 Chak et al. ..... 100/26

* cited by examiner

*Primary Examiner*—Anthony D. Stashick
(74) *Attorney, Agent, or Firm*—Troxell Law Office PLLC

(57) ABSTRACT

A strapping machine includes a machine body with a package-strapping space. A strap is fed to the package-strapping space. A spring-loaded swing arm is pivoted to the machine body, and is associated with a rotating shaft via a cam unit such that rotation of the shaft results in turning of the swing arm relative to the machine body. An electrically operated clamp unit is mounted movably on the swing arm, and is movable relative to a strap passage in the swing arm. A delay circuit is electrically coupled to a detecting device and the clamp unit. When the detecting device detects a first position of the swing arm, the delay circuit will actuate the clamp unit to move from a releasing position to a clamping position after a preset delay time. When the detecting device detects a second position of the swing arm, the clamp unit is immediately actuated to move from the clamping position to the releasing position.

4 Claims, 13 Drawing Sheets

STRAPPING MACHINE WITH A STRAP TIGHTENING ADJUSTMENT UNIT

BACKGROUND OF THE INVENTION

1. Field of the Invention

The invention relates to a strapping machine, more particularly to a strapping machine with a strap tightening adjustment unit of a simple structure.

2. Description of the Related Art

Referring to FIGS. 1 to 3, a conventional strapping machine is shown to include a machine body 1, a strap supply reel 14, a strap feed unit 13, a rotating shaft unit 122, and a strap tightening adjustment unit 4.

As illustrated, the machine body 1 defines an accommodating space 11 and a package-strapping space 12 above the accommodating space 11. The strap supply reel 14 is mounted on an exterior of the machine body 1. A bundle of strap 2 is mounted on the strap supply reel 14, and has a leading end fed into the package-strapping space 12 by the strap feed unit 13 in such a manner that a package strapping operation can be done in the package-strapping space 12. The rotating shaft unit 122 is journalled in the accommodating space 11 of the machine body 1, and is formed with a cam unit 123.

The strap tightening adjustment unit 4 includes a spring-loaded swing arm 41, a clamp unit 5, and a strap tension adjuster 6. A mounting shaft 113 extends through a mounting bracket 111 of the machine body 1 and the swing arm 41 to mount the latter pivotally within the accommodating space 11. The swing arm 41 is further associated with the rotating shaft unit 122 via the cam unit 123 in such a manner that rotation of the shaft unit 122 results in turning of the swing arm 41 relative to the machine body 1 along a travelling path 131 between an upper position adjacent to the package-strapping space 12 and a lower position distal from the package-strapping space 12. The swing arm 41 defines a strap passage 414 to permit extension of the strap 2 therethrough, and a rod-path 415 in spatial communication with the strap passage 414. The clamp unit 5 includes a clamp piece 54, a push rod 51, and a torsional spring 52. The clamp piece 54 is mounted pivotally on the swing arm 41 via a pivot 53. The push rod 51 is disposed movably in the rod-path 415 of the swing arm 41, and is operably associated with the clamp piece 54. The torsional spring 52 is sleeved around the pivot 53 so as to urge the push rod 51 in the rod-path 415 toward a first direction away from the strap passage 414 so as to relieve clamping of the clamp piece 54 relative to the strap 2. The strap tension adjuster 6 includes an adjuster shaft 61 which is mounted rotatably in the mounting bracket 111 of the accommodating space 11 and which extends parallel to and adjacent to the mounting shaft 113, a spring-loaded rod pusher 64 which is sleeved on the mounting shaft 113 and which urges the push rod 51 to move in a second direction opposite to the first direction so as to result in clamping of the clamp piece 54 relative to the strap 2 in the strap passage 414, and a tension adjusting wheel 62 which is fixed eccentrically on the adjuster shaft 61 and which is in sliding contact with the rod pusher 64 via a coupler unit 63.

When the swing arm 41 is pivoted to a position between the upper and lower positions by virtue of rotation of the shaft unit 122, the rod pusher 64 and the coupler unit 63 concurrently rotate with the swing arm 41. Collision of a protrusion 631 on the coupler unit 63 with the adjusting wheel 62 results in stoppage of the rotation of the coupler unit 63 on the shaft 113, which in turn, results in movement of the clamp piece 54 in the second direction toward the strap passage 414 of the swing arm 41 by virtue of urging action of the rod pusher 64 against the push rod 51 (see FIG. 4), thereby clamping and tightening the strap 2 around the package that is disposed in the package-strapping space 12 of the machine body 1.

Note that the strap tightening adjustment unit 4 of the conventional strap machine includes a relatively large number of components, and is therefore consequently complicated in structure and incurs a long assembly time during the manufacture of the conventional strapping machine.

SUMMARY OF THE INVENTION

Therefore, the object of this invention is to provide a strapping machine with a strap tightening adjustment unit of a simple structure so as to overcome the aforementioned disadvantages that are associated with the conventional strapping machine.

Accordingly, a strapping machine of the present invention includes a machine body, a strap supply reel, a strap feed unit, a rotating shaft unit, and a strap tightening adjustment unit. The machine body defines an accommodating space and a package-strapping space above the accommodating space. The strap supply reel is mounted on the machine body, and is adapted to hold a bundle of strap thereon. The strap feed unit is capable of feeding the strap from the strap supply reel to the package-strapping space of the machine body. The rotating shaft unit is journalled in the accommodating space of the machine body, and is formed with a cam unit. The strap tightening adjustment unit includes a spring-loaded swing arm, an electrically operated clamp unit, a detecting device, and a delay circuit. The swing arm is pivoted to the machine body within the accommodating space, and is associated with the rotating shaft unit via the cam unit in such a manner that rotation of the shaft unit results in turning of the swing arm relative to the machine body between an upper position adjacent to the package-strapping space and a lower position distal from the package-strapping space. The swing arm defines a strap passage which is adapted to permit extension of the strap therethrough. The clamp unit is mounted movably on the swing arm, and is movable relative to the strap passage between a clamping position, in which the strap is clamped by the clamp unit, and a releasing position, in which the strap is released from the clamp unit. The delay circuit is electrically coupled to the detecting device and the clamp unit. When the detecting device detects a first position of the swing arm between the upper and lower positions, the delay circuit will actuate the clamp unit to move from the releasing position to the clamping position after a preset delay time. When the detecting device detects a second position of the swing arm between the first and lower positions, the clamp unit is immediately actuated to move from the clamping position to the releasing position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
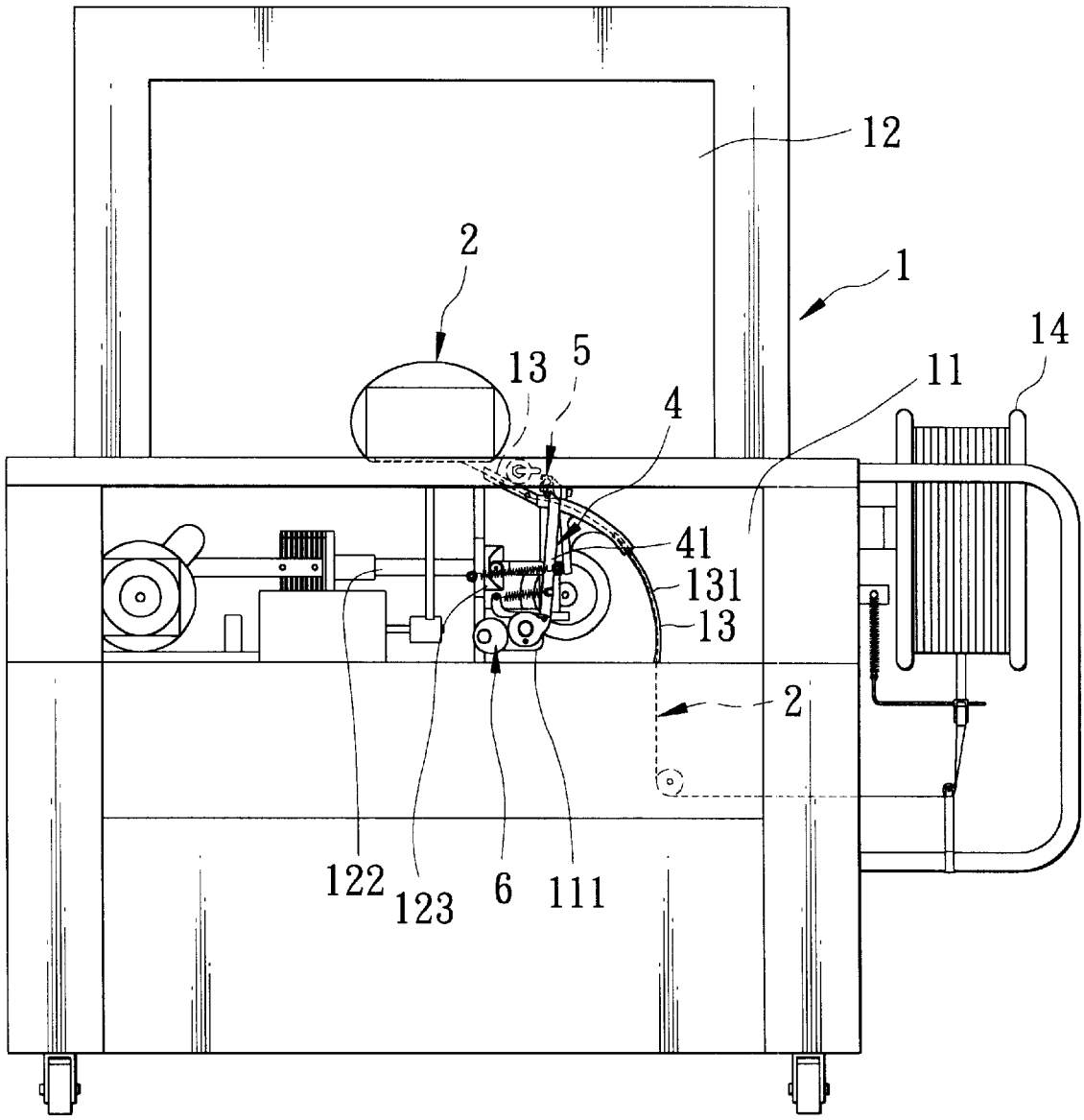
FIG. 1 PRIOR ART
FIG. 1 is a schematic view of a conventional strapping machine for strapping a package.
Figure 2:
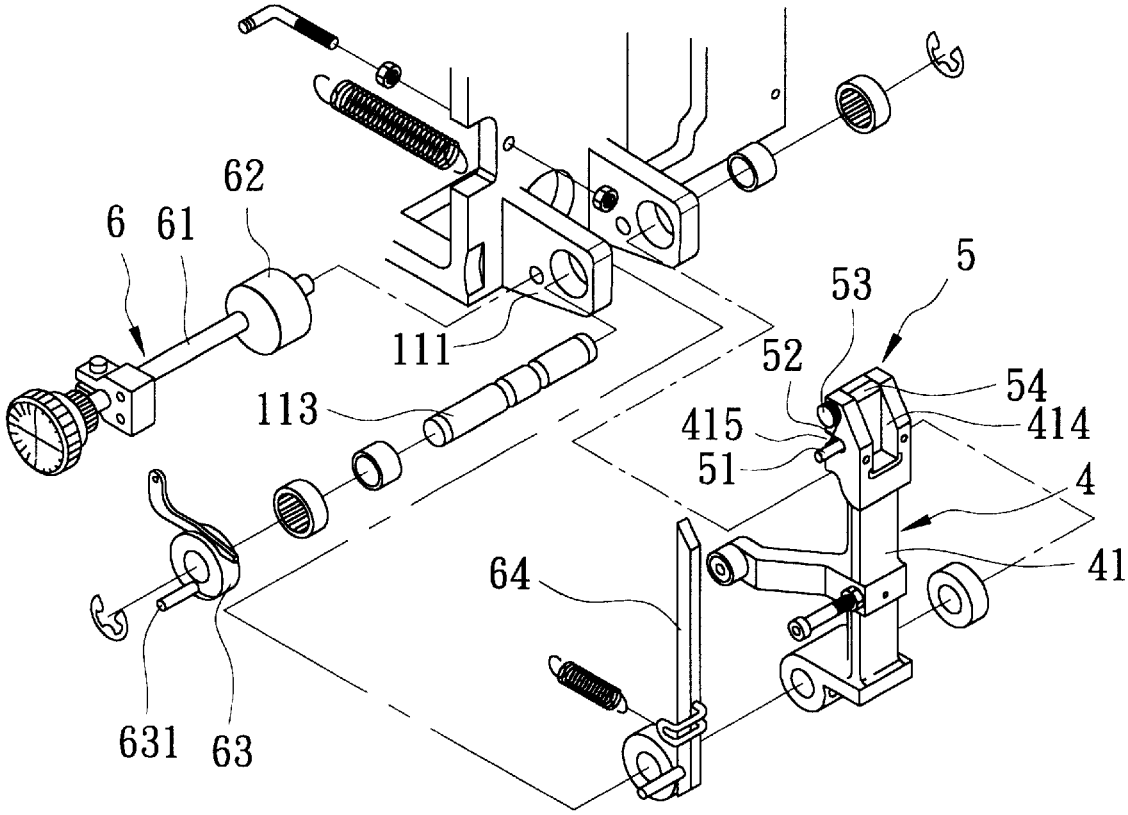
FIG. 2 PRIOR ART
FIG. 2 is a fragmentary exploded perspective view to illustrate a strap tightening adjustment unit of the conventional strapping machine.
Figure 3:
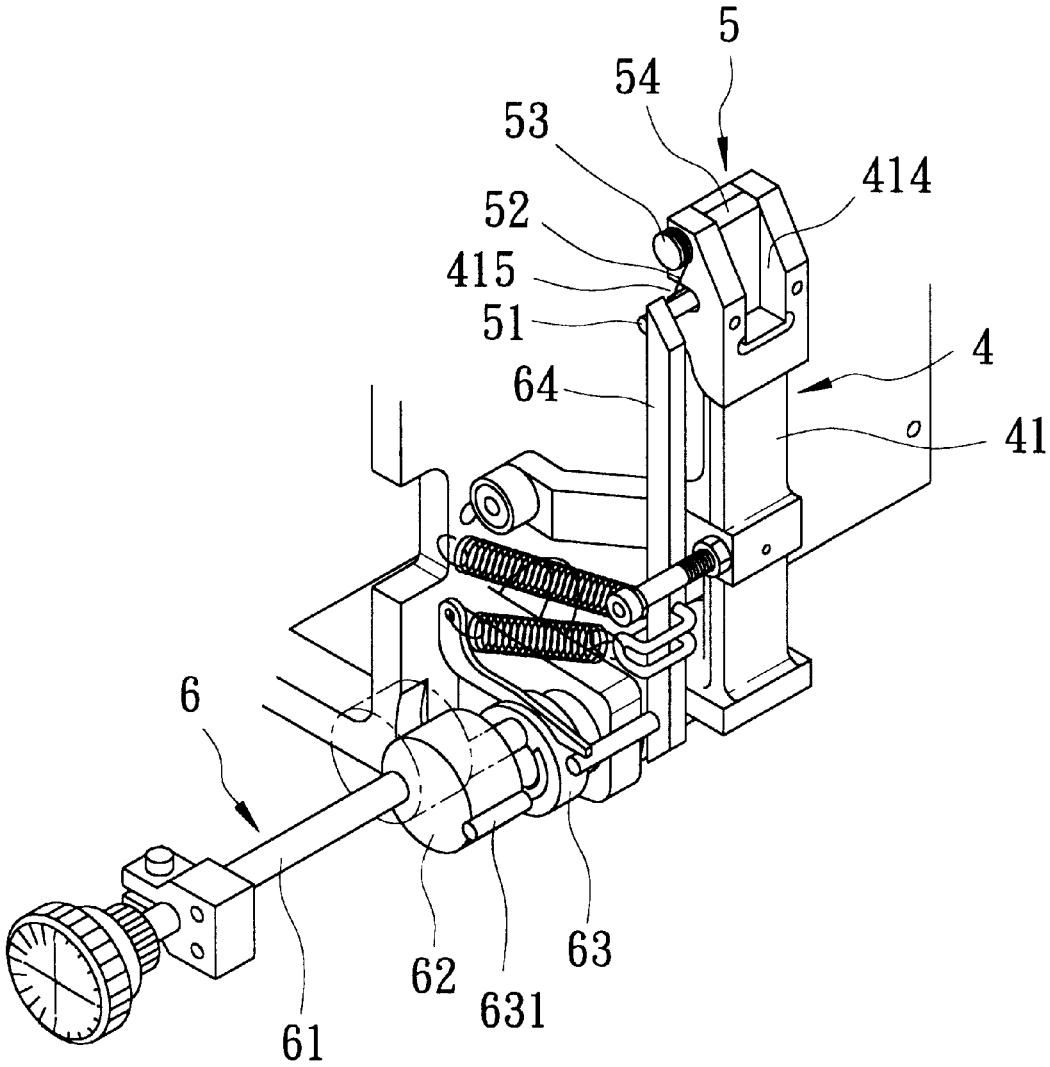
FIG. 3 PRIOR ART
FIG. 3 is a fragmentary assembled perspective view of the conventional strapping machine, illustrating how the strap tightening adjustment unit is mounted on a machine body.
Figure 4:
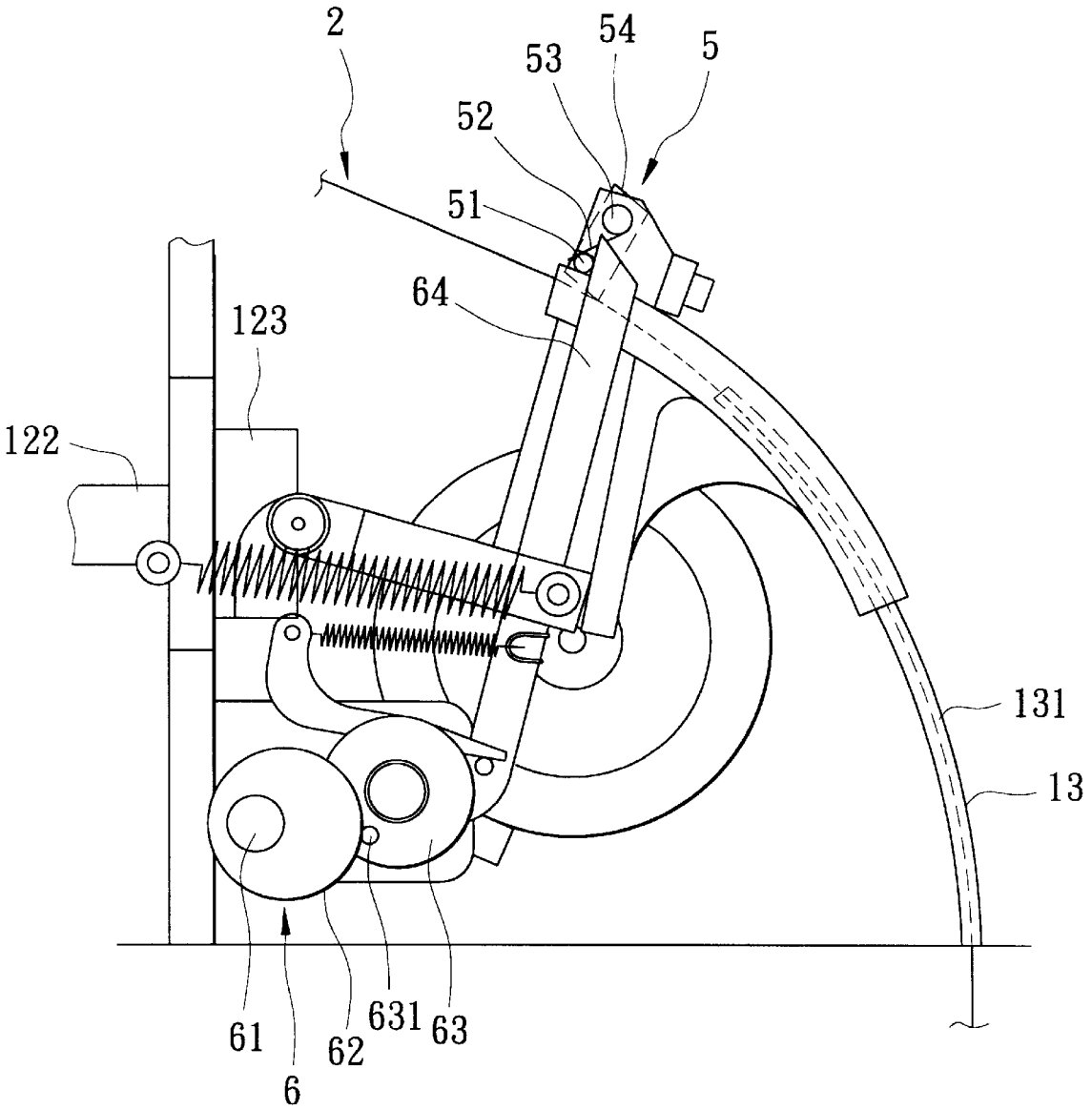
FIG. 4 PRIOR ART
FIG. 4 is a fragmentary schematic view of the conventional strapping machine, illustrating how the strap tightening adjustment unit is operated.
Figure 5:
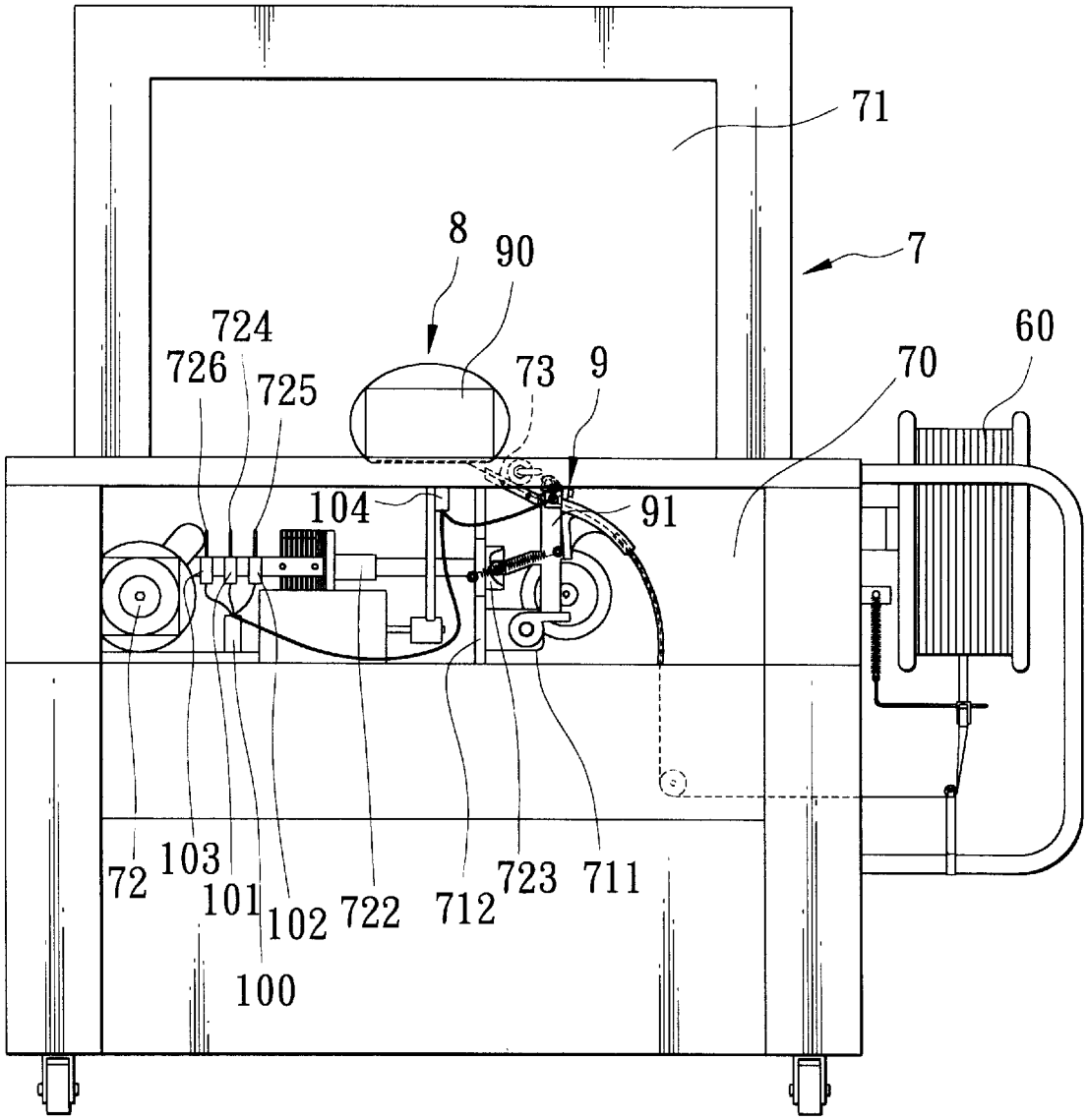
FIG. 5 is a schematic view of a preferred embodiment of a strapping machine according to the present invention.
Figure 6:
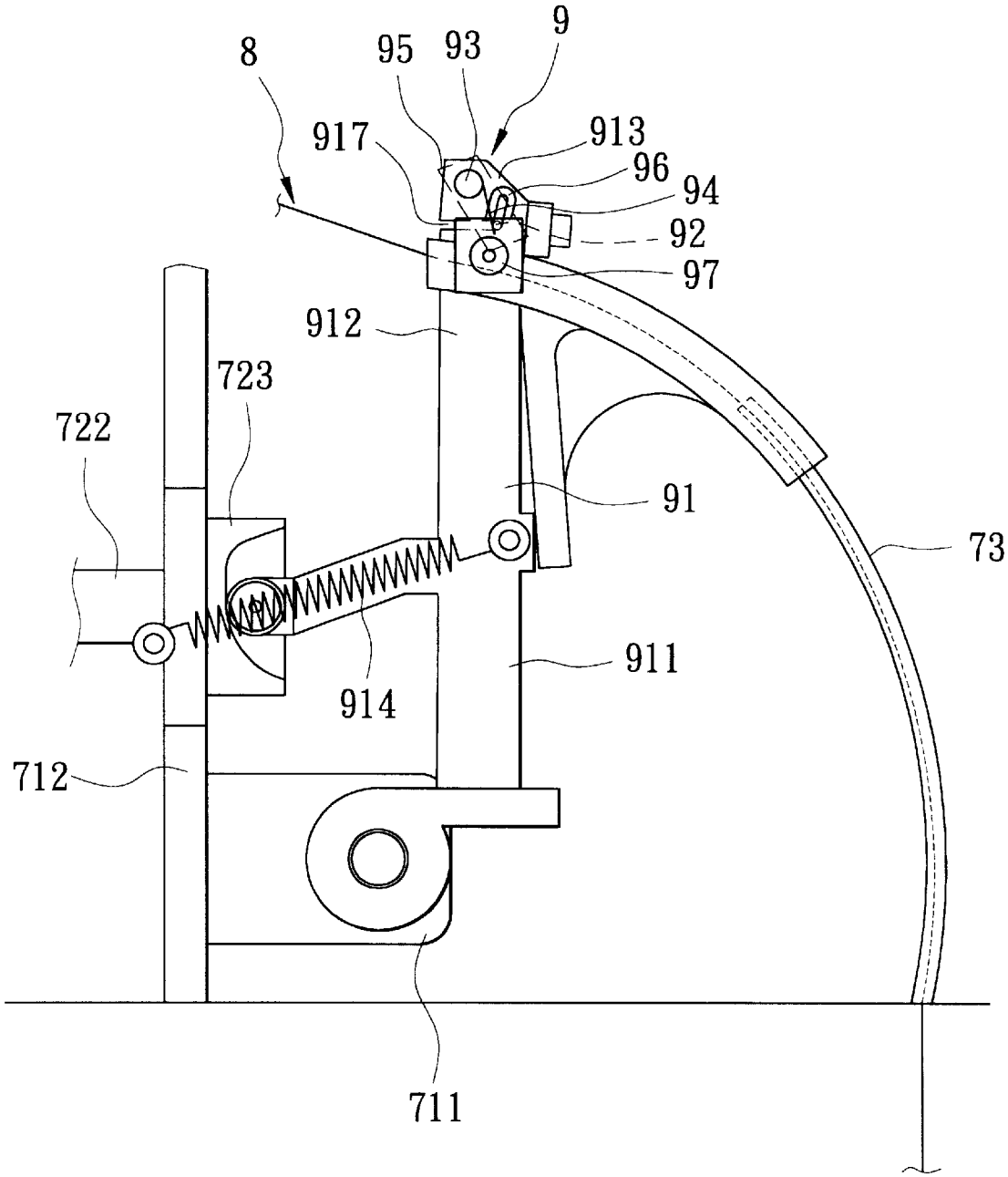
FIG. 6 is a fragmentary schematic view of the preferred embodiment, illustrating how a swing arm of a strap tightening adjustment unit is mounted on a machine body.
Figure 7:
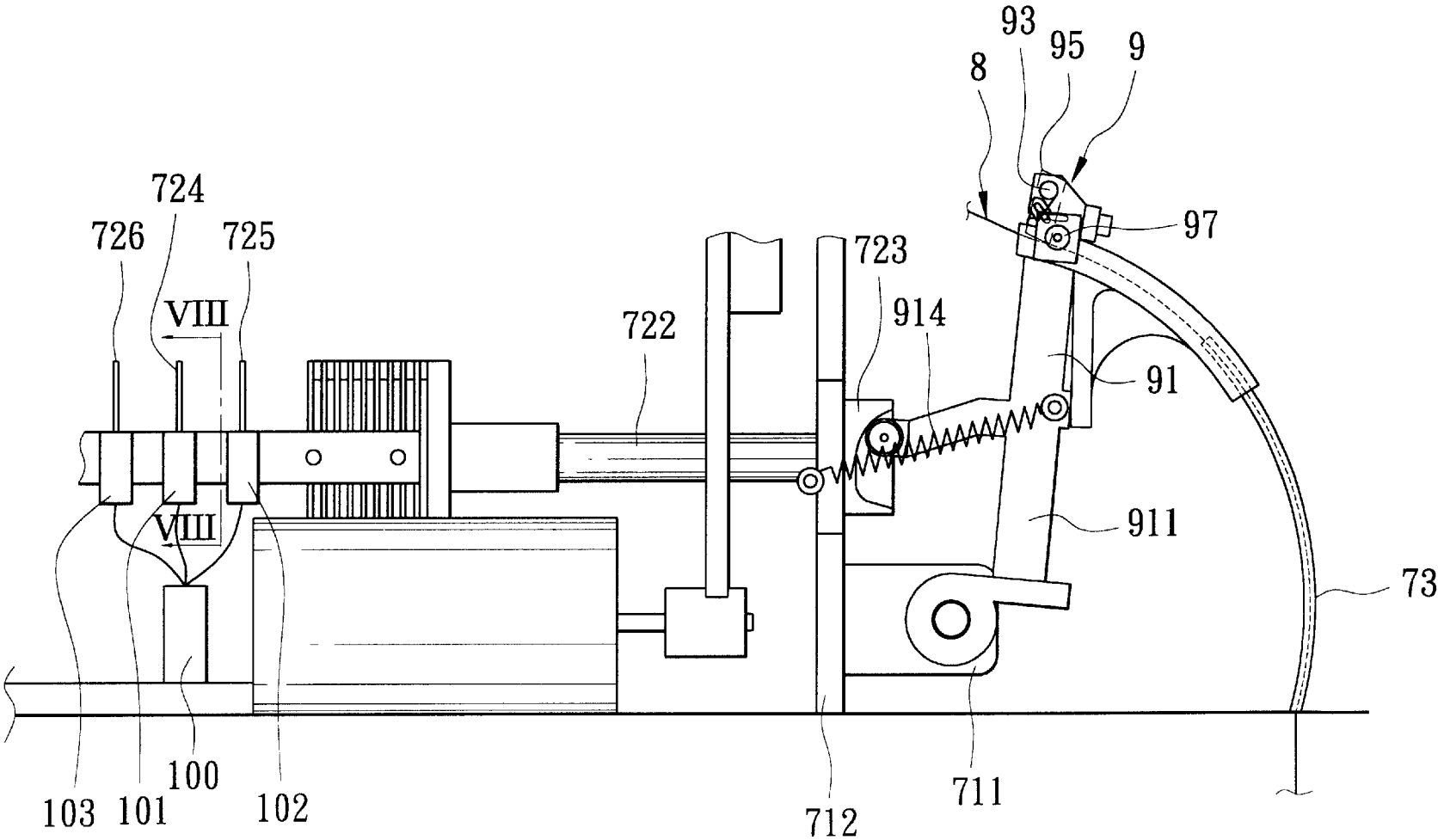
FIG. 7 is a fragmentary schematic view of the preferred embodiment, illustrating how the swing arm of the strap tightening adjustment unit is actuated so as to move the same to a first position.

Referring to FIGS. 5, 6, and 7, the preferred embodiment of a strapping machine for strapping a package 90 according to the present invention is shown to include a machine body 7, a strap supply reel 60, a strap feed unit 73, a rotating shaft unit 722, and a strap tightening adjustment unit 9.

As illustrated, the machine body 7 defines an accommodating space 70 and a package-strapping space 71 above the accommodating space 70. The package 90 is disposed in the package-strapping space 71 of the machine body 7 for strapping.

The strap supply reel 60 is mounted on the machine body 7, and holds a bundle of strap 8 thereon.

The strap feed unit 73 is disposed in the accommodating space 70 of the machine body 7, and can feed the strap 8 from the strap supply reel 60 to the package-strapping space 71 in such a manner that after encircling around the package 90, a distal end of the strap 8 is fixedly retained underneath on a support plate that supports the package 90 thereon.

The rotating shaft unit 722 is journalled between two mounting walls 712 (only one is shown in FIGS. 6 and 7) in the accommodating space 70 of the machine body 7, and is formed with a cam unit 723.

The strap tightening adjustment unit 9 includes a spring-loaded swing-arm 91, an electrically operated clamp unit 95, a detecting device 100, and a delay circuit 104. The swing arm 91 has a lower portion 911 pivoted to a pivot seat 711 within the accommodating space 70 of the machine body 7, and is associated with the rotating shaft unit 722 via the cam unit 723 in such a manner that rotation of the shaft unit 722 results in turning of the swing arm 91 relative to the seat 711 between an upper position adjacent to the package-strapping space 71, as best shown in FIG. 5, and a lower position (not shown) distal from the package-strapping space 71. The swing arm 91 has an upper portion 912 that is formed with a strap passage 916 (see FIG. 9) to permit extension of the strap 8 therethrough when the strap 8 is fed by the strap feed unit 73 from the strap supply reel 60 to the package-strapping space 71 of the machine body 7. The clamp unit 95 is mounted movably on the swing arm 91, and is movable relative to the strap passage 916 between a clamping position, in which the strap 8 is clamped by the clamp unit 95, and a releasing position, in which the strap 8 is released from the clamp unit 95.

Figure 10:
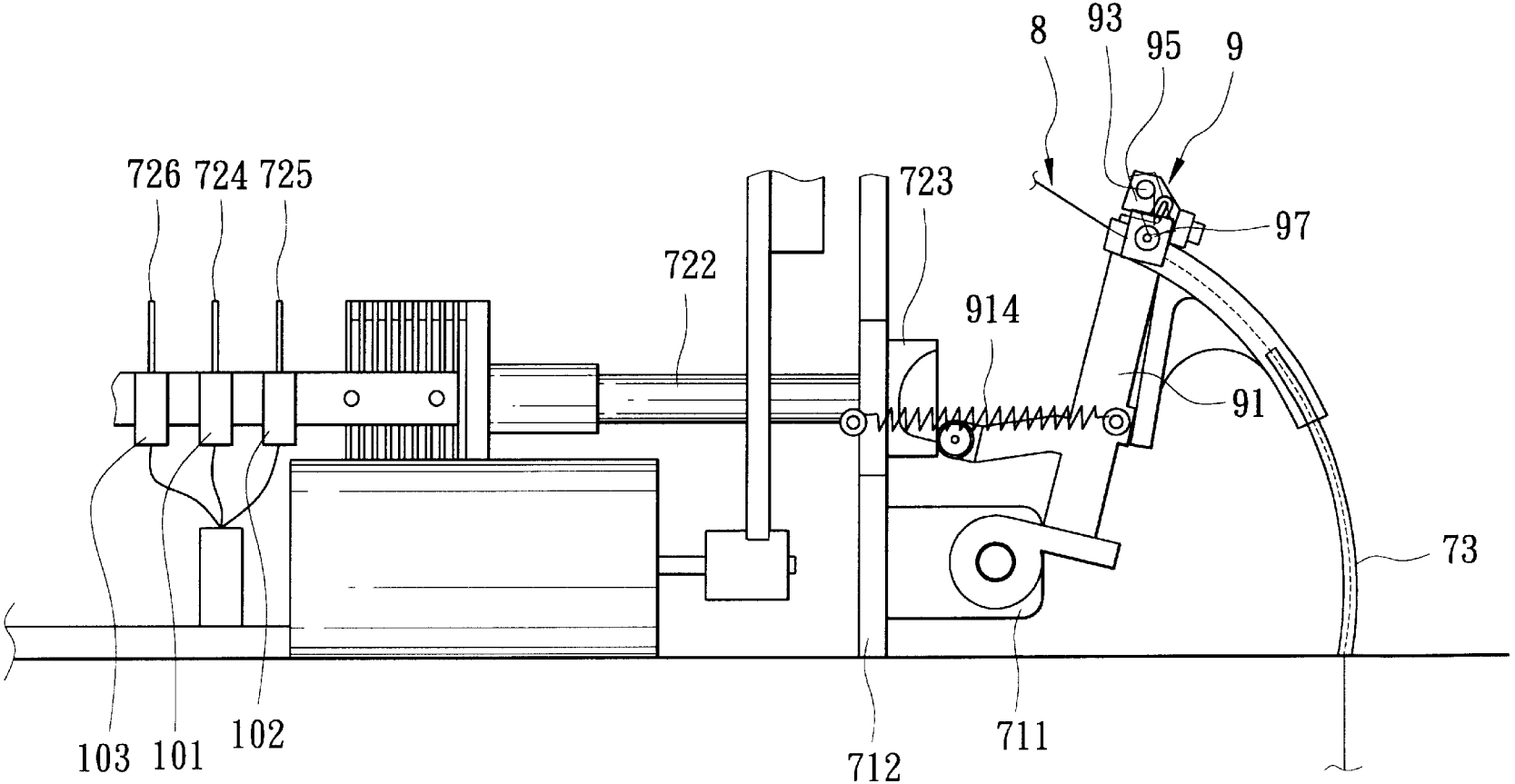
FIG. 10 is a fragmentary schematic view of the preferred embodiment, illustrating how the swing arm of the strap tightening adjustment unit is actuated in order to tighten a strap relative to the package.

The delay circuit 104 is electrically coupled to the detecting device 100 and the clamp unit 95 in such a manner that when the detecting device 100 detects a first position of the swing arm 91 between the upper and lower positions, as best shown in FIG. 7, the delay circuit 104 will actuate the clamp unit 95 to move from the releasing position to the clamping position after a preset delay time. Under this condition, the strap 8 around the package 90 is tightened by virtue of rotation of the shaft unit 722 and concurrent movement of the upper portion 912 of the swing arm 91 from the upper position to the first position. When the detecting device 100 detects a second position of the swing arm 91 between the first and lower positions (see FIGS. 10 and 11), the clamp unit 95 is immediately actuated to move from the clamping position to the releasing position, which in turn releases the strap 8 from the clamp unit 95.

Figure 8:
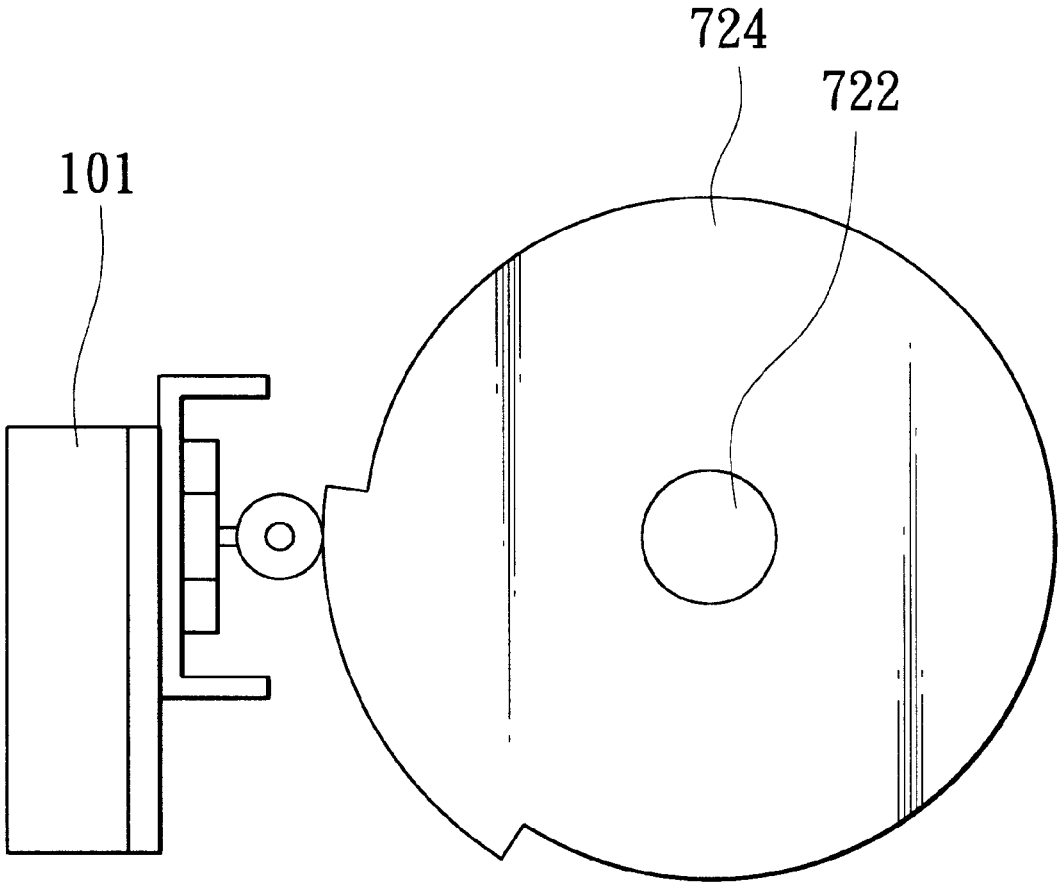
FIG. 8 is a schematic view of the preferred embodiment, viewed from line VIII—VIII in FIG. 7, illustrating how a first micro switch is actuated by a first actuator mounted fixedly on a rotating shaft.
Figure 11:
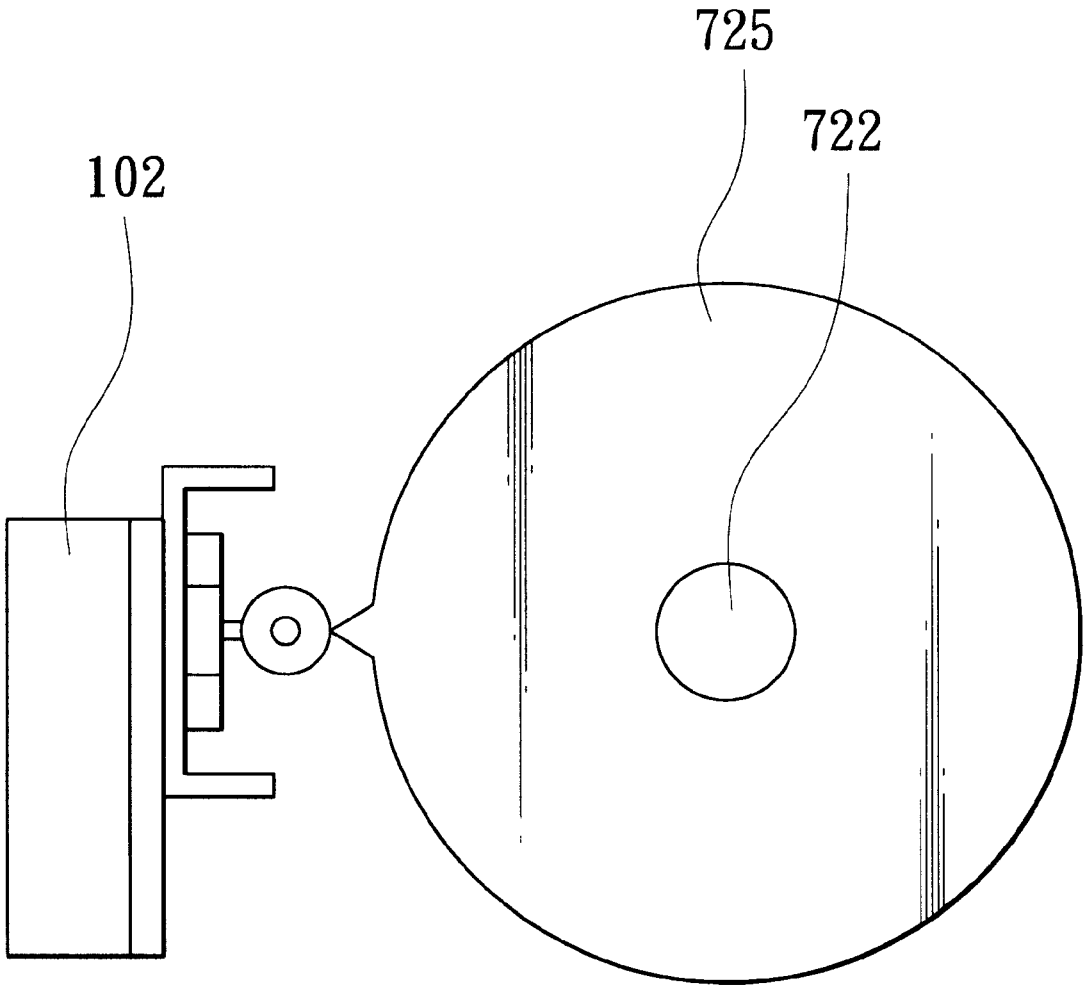
FIG. 11 illustrates how a second micro switch is actuated by a second actuator in the preferred embodiment.
Figure 12:
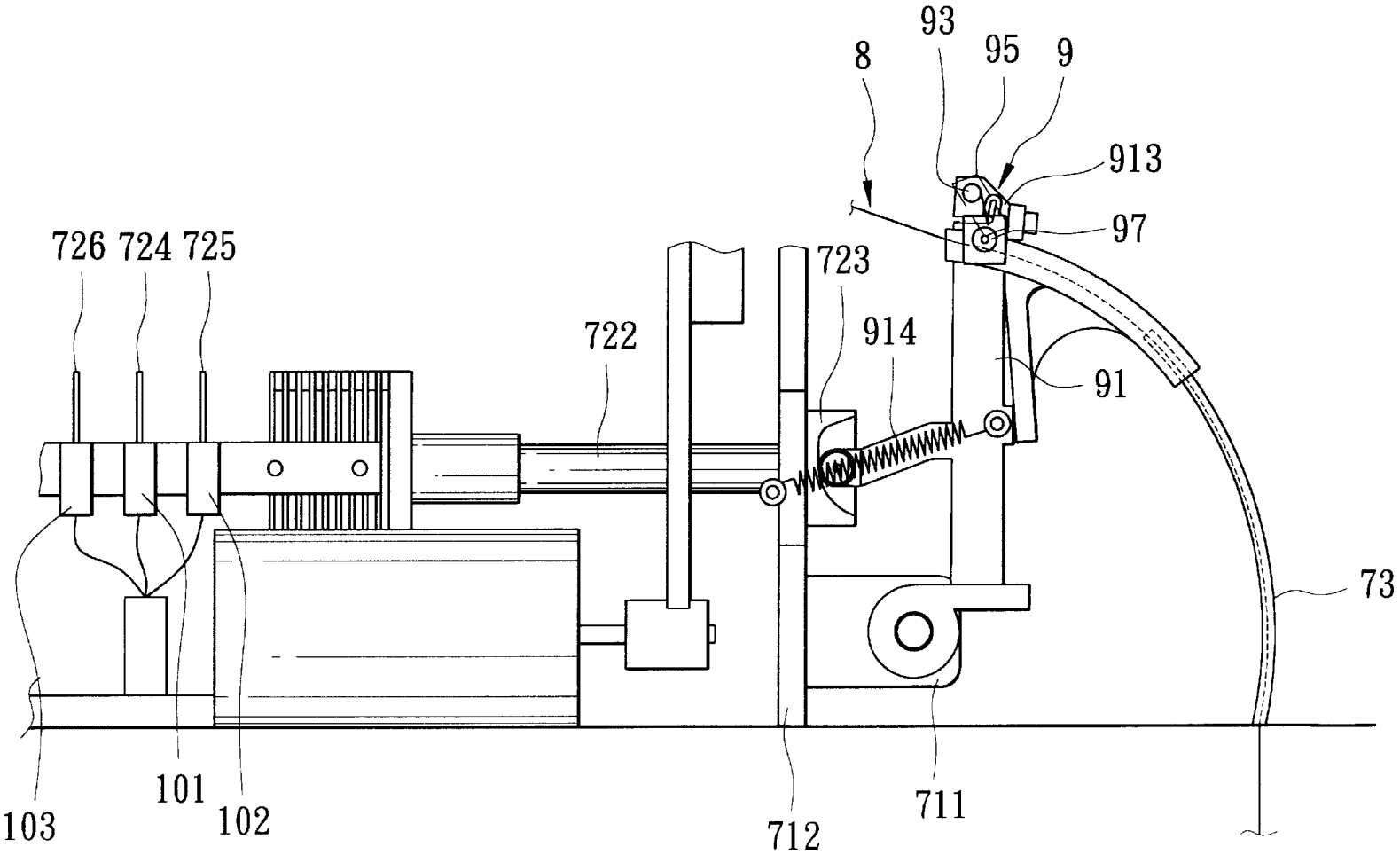
FIG. 12 is a fragmentary schematic view of the preferred embodiment, illustrating how the swing arm of the tightening adjustment unit is restored to its initial position.
Figure 13:
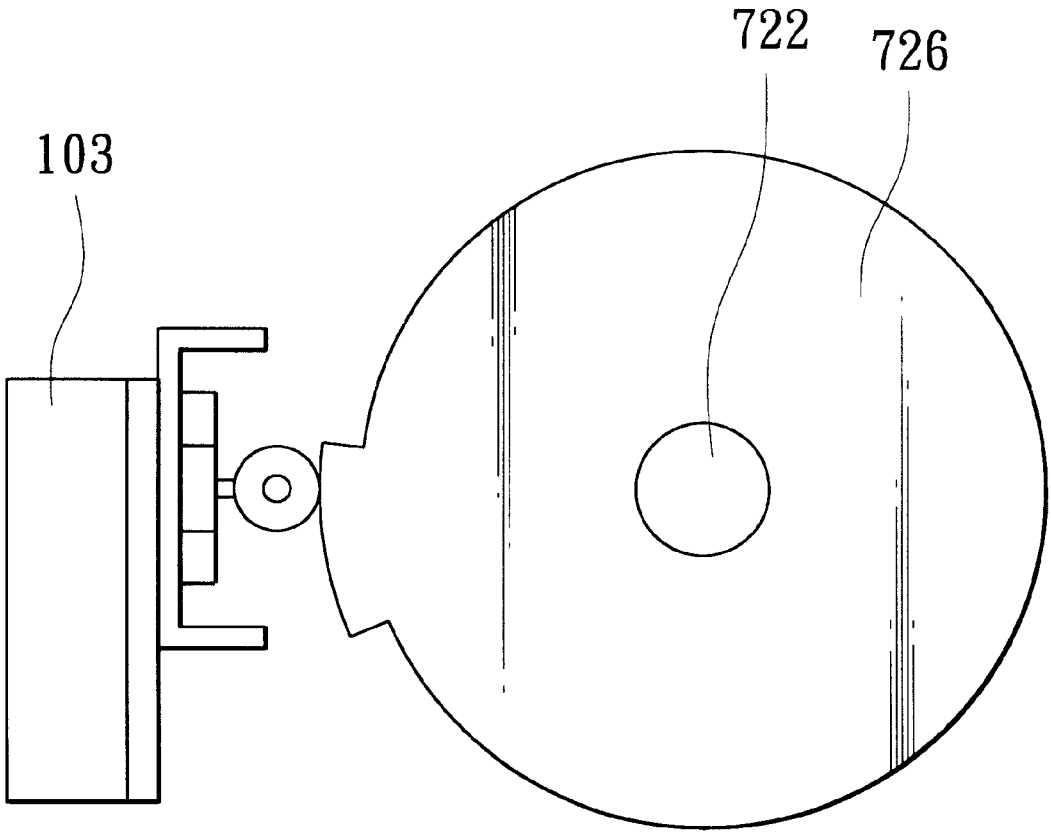
FIG. 13 illustrates how a third micro switch is actuated by a third actuator in the preferred embodiment.

The detecting device 100 includes first and second micro switches 101,102 which are disposed in the accommodating space 70 of the machine body 7 adjacent to the rotating shaft unit 722 and which are electrically coupled to the delay circuit 104, and first and second actuators 724,725 which are fixed on the rotating shaft unit 722 and which are capable of contacting the first and second micro switches 101,102 respectively when the swing arm 91 is at the first and second positions, as best shown in FIGS. 8 and 11. A drive unit 72 is provided for rotating the rotating shaft unit 722. The detecting device 100 further includes a third micro switch 103 which is disposed in the accommodating space 70 of the machine body 7 adjacent to the rotating shaft unit 722 and which is electrically coupled to the drive unit 72, and a third actuator 726 which is fixed on the rotating shaft unit 722 and which is capable of contacting the third micro switch 103 when the swing arm 91 is at the lower position to control the drive unit 72 to stop rotation of the shaft unit 722, as best shown in FIGS. 12 and 13. Under this condition, the swing arm 91 is moved back to its initial position of FIG. 12 by virtue of tension force of a spring 914 which interconnects the mounting wall 712 and the swing arm 91.

In this preferred embodiment, the delay circuit 104 includes a motor 97 operably connected to the clamp unit 95 via a turning plate 96 and a push rod 92 (see FIG. 9) in such a manner that the motor 97 rotates in a first direction so as to move the clamp unit 95 from the releasing position to the clamping position when the first actuator 724 contacts the first micro switch 101. In the same manner, the motor 97 rotates in a second direction opposite to the first direction so as to move the clamp unit 95 from the clamping position to the releasing position when the second actuator 725 contacts the second micro switch 102.

Figure 9:
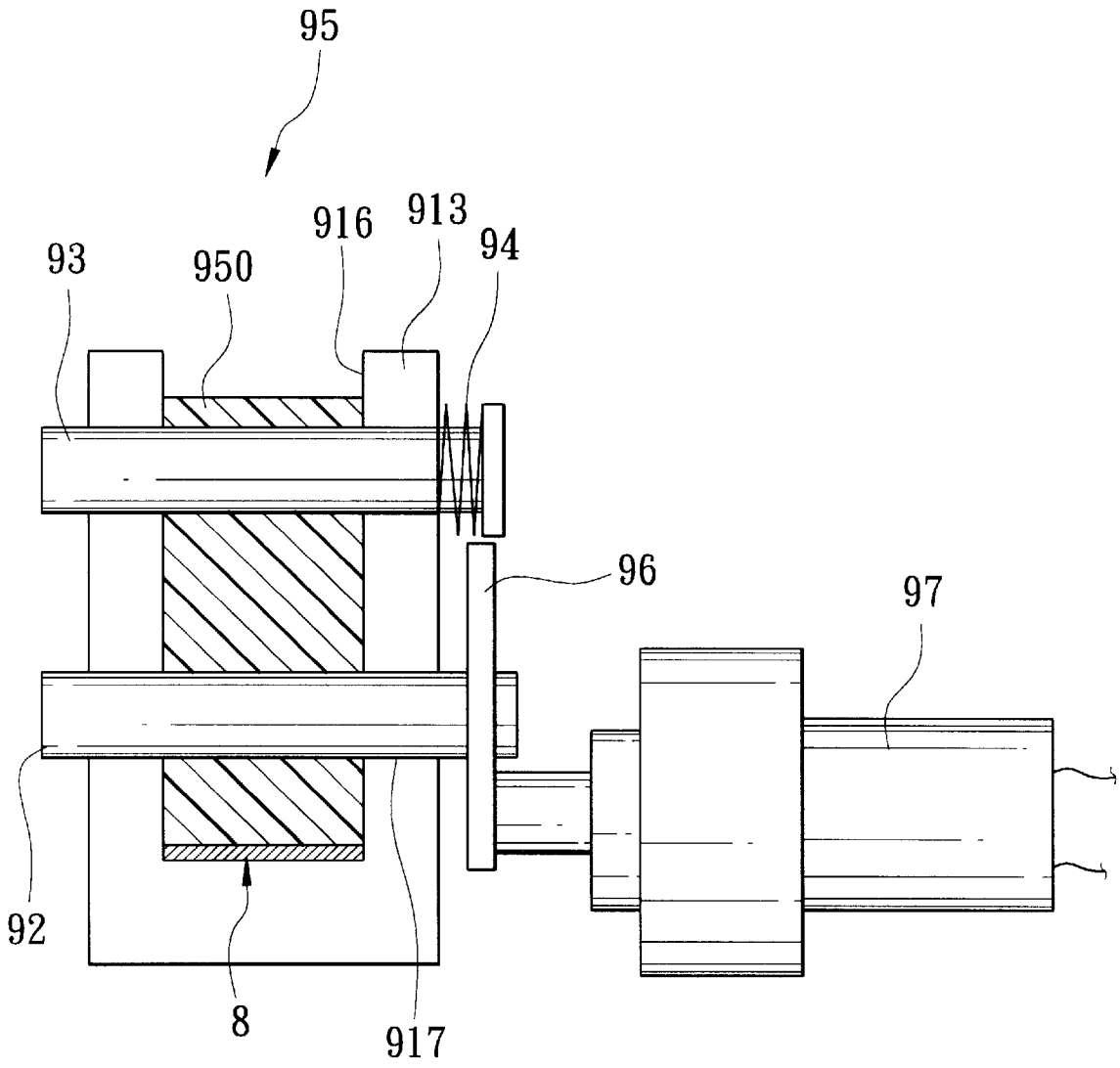
FIG. 9 shows a clamp unit of the preferred embodiment at a clamping position.

Referring to FIG. 9, the clamp unit 95 preferably includes a u-shaped clamp seat 913 which is fixed on the upper portion 912 of the swing arm 91 (see FIG. 6) and which defines the strap passage 916 and a push-rod path 917 that is disposed above the strap passage 916 and that receives the push rod 92 therein, a clamp piece 950 pivoted to the seat 913 via a pivot 93, and an urging member 94 that is sleeved around the pivot 93 and that urges the clamp piece 950 via the push rod 92 so as to clamp the strap 8 in the strap passage 916 of the seat 913 when the motor 97 rotates in the first direction.

We claim:

1. A strapping machine for strapping a package, comprising:

a machine body defining an accommodating space and a package-strapping space above said accommodating space;

a strap supply reel mounted on said machine body and adapted to hold a bundle of strap thereon;

a strap feed unit capable of feeding the strap from said strap supply reel to said package-strapping space;

a rotating shaft unit journalled in said accommodating space, and formed with a cam unit;

a strap tightening adjustment unit including a spring-loaded swing arm pivoted to said machine body within said accommodating space and associated with said rotating shaft unit via said cam unit in such a manner that rotation of said shaft unit results in turning of said swing arm relative to said machine body between an upper position adjacent to said package-strapping space and a lower position distal from said package-strapping space, said swing arm defining a strap passage adapted to permit extension of the strap therethrough, an electrically operated clamp unit mounted movably on said swing arm and movable relative to said strap passage between a clamping position, in which the strap is clamped by said clamp unit, and a releasing position, in which the strap is released from said clamp unit, a detecting device, and a delay circuit electrically coupled to said detecting device and said clamp unit, wherein, when said detecting device detects a first position of said swing arm between said upper and lower positions, said delay circuit will actuate said clamp unit to move from said releasing position to said clamping position after a preset delay time, and wherein, when said detecting device detects a second position of said swing arm between said first and lower positions, said clamp unit is immediately actuated to move from said clamping position to said releasing position.

2. The strapping machine as defined in claim 1, wherein said detecting device includes first and second micro switches disposed in said accommodating space of said machine body adjacent to said rotating shaft unit and electrically coupled to said delay circuit, and first and second actuators which are fixed on said rotating shaft unit and which are capable of contacting said first and second micro switches respectively when said swing arm is at said first and second positions.

3. The strapping machine as defined in claim 2, further comprising a drive unit for rotating said rotating shaft unit, said detecting device further including a third micro switch disposed in said accommodating space of said machine body adjacent to said rotating shaft unit and electrically coupled to said drive unit, and a third actuator which is fixed on said rotating shaft unit and which is capable of contacting said third micro switch when said swing arm is at said lower position so as to control said drive unit to stop rotation of said rotating shaft unit.

4. The strapping machine as defined in claim 2, wherein said delay circuit includes a motor operably connected to said clamp unit, said motor rotating in a first direction so as to move said clamp unit from said releasing position to said clamping position when said first actuator contacts said first micro switch, said motor rotating in a second direction opposite to said first direction so as to move said clamp unit from said clamping position to said releasing position when said second actuator contacts said second micro switch.

* * * * *